US006974193B2

(12) United States Patent
Gaser et al.

(10) Patent No.: US 6,974,193 B2
(45) Date of Patent: Dec. 13, 2005

(54) POWER OPERATED BRUSH AND METHOD

(75) Inventors: Joseph P. Gaser, Willoughby Hills, OH (US); Maximo Hartwig Buch, Puzol (ES)

(73) Assignee: Jason Incorporated, Cleveland, OH (US)

( * ) Notice: Subject to any disclaimer, the term of this patent is extended or adjusted under 35 U.S.C. 154(b) by 483 days.

(21) Appl. No.: 10/217,554

(22) Filed: Aug. 13, 2002

(65) Prior Publication Data

US 2004/0031117 A1 Feb. 19, 2004

(51) Int. Cl.[7] ..... A46D 3/00; A46B 13/02
(52) U.S. Cl. ..... 300/21; 15/179
(58) Field of Search ..... 15/179, 181; 300/21

(56) References Cited

U.S. PATENT DOCUMENTS 1,975,567 A * 10/1934 Dossmann ..... 15/179
3,574,880 A * 4/1971 Butzen ..... 15/179
4,173,807 A * 11/1979 Maier ..... 15/179
4,779,932 A * 10/1988 Boland et al. ..... 300/21
5,193,243 A * 3/1993 Stegens ..... 15/179
5,598,600 A * 2/1997 Stegens ..... 15/179

* cited by examiner

*Primary Examiner*—Randall Chin
(74) *Attorney, Agent, or Firm*—John W. Renner; Renner, Otto, Boisselle & Sklar

(57) ABSTRACT

A power operated brush or buff and method includes a plurality of brush or buff rolls mounted on a drive arbor. End caps provide a torque connection between the ends of the outermost rolls and the drive arbor while a bridge ring provides a torque connection between the adjoining ends of the rolls. The rolls, end caps and bridge rings are formed of a plastic material for ease of assembly and disassembly. The rolls are extruded with an interior spline while the end caps and bridge rings are provided with a short exterior spline section to form the torque connection.

8 Claims, 2 Drawing Sheets

POWER OPERATED BRUSH AND METHOD

DISCLOSURE

This invention relates generally as indicated to a power operated brush and method, and more particularly, to a brush or buff assembly which can be built in substantially any length from one or more plastic cylindrical brush or buff sections or hubs, or partial sections, mounted on a common drive arbor, which can be driven from either end.

BACKGROUND OF THE INVENTION

In many industrial applications power driven rotary brushes or buffs of various lengths are required and these are sometimes formed by stacking brush or buff rings on a drive arbor and compressing and locking them in place. The replacement of a damaged portion, or one or more rings, or a change in axial length, requires significant process or machine downtime. In fact, manipulation of relatively large brush rolls generally requires removal from the machine and manipulation on special jigs, stands or presses.

Also in many industrial applications fluids are also involved in addition to the brushing or cleaning operation, whether it be coolants, slurries, or just plain water in less aggressive process or machine applications such as fruit or vegetable cleaning or waxing. In such applications the fruit may be sprayed or washed as it tumbles or rolls between brushes.

While the drive arbor may be metal, such as a tube, pipe or shaft, it is preferable that the cylindrical brush segments be corrosion immune plastic and be capable of being quickly and easily assembled on the arbor, and when assembled protecting the interior against fluid intrusion. It is also important that the brush or buff assembly be formed of few common parts which can easily be assembled or disassembled with conventional tools such as small rubber mallets, all at substantially reduced cost.

SUMMARY OF THE INVENTION

Plastic cylindrical brush or buff segments include hubs which are provided in standard length which may vary widely in axial length. The standard module length may vary from a few inches to a foot or more. The exterior of the hub may be provided with circumferential rows of tufts stapled in sockets. For fruit or vegetable cleaning, the brush bristles are a relatively compliant natural or flexible plastic material. The bristle or tuft arrangement may vary from a completely filled brush to a brush with a spiral arrangement of tufts. The completely filled brush has higher bristle density while the spiral arrangement permits rotation of the brush to convey work axially of the brush without inclining the arbor or otherwise conveying the work. The annular row arrangement however permits the brush segment section to be cut to substantially any desired length without disturbing the bristle arrangement.

The hub of the segment may be formed by molding or preferably by extrusion and the interior is formed with spaced spline grooves and ridges. A variety of low cost plastic materials or resins may be employed having the requisite strength and rigidity. It is however preferable that the plastic material have some degree of surface lubricity so that the desired number of segments can quickly be assembled or disassembled on the drive arbor.

The brush segments may be assembled on the arbor with end caps and one or more bridge rings, each of which is provided with a short axial section having exterior spline ridges and grooves which mate with, seat, and seal in the ends of the brush segment sections. The end caps may include a projecting socket for receipt of a suitable drive shaft or coupling, or the end cap may have no socket and if the arbor is tubular, a separate end plug may be employed. The end cap opposite the end cap with the drive socket may also be identical except that the socket in the axial projection is cylindrical. In this manner the end cap may be mounted on an internal or external journal. The bridge rings slide on the arbor and have symmetrically oppositely facing short external spline sections separated by a center ridge or unsplined section against which the ends of the brush segments seat and seal. The bridge rings are not otherwise secured to the arbor but lock the axially abutting brush sections against relative torsional twisting.

The end caps are provided with flanges against which the ends of the outermost segments seat, and the end caps may be pinned or otherwise secured to the arbor.

The entire brush may quickly be assembled or disassembled with relatively simple tools, such as the small rubber mallet for forcing the parts axially for separation, or axially for assembly and sealing. The power operated brush and method is ideal for fruit or vegetable cleaning and preparation where the length of exposure of the work to the brush or the through-put can quickly be in effect custom made.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
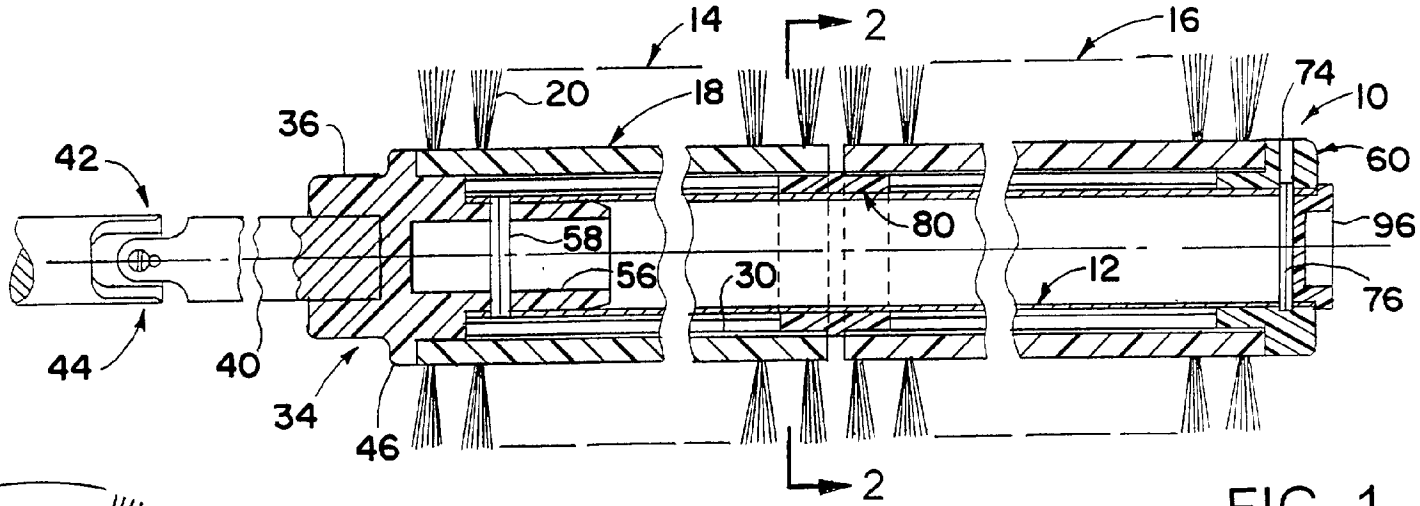
FIG. 1 is a broken away section of the power driven brush showing the brush rolls, ends caps and bridge ring mounted on the drive arbor.
Figure 4:
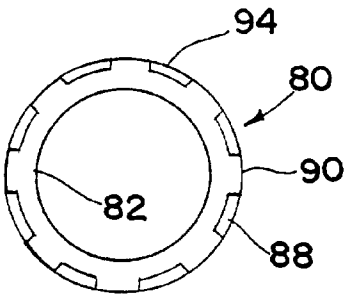
FIG. 4 is an end elevation of the bridge ring.
Figure 3:
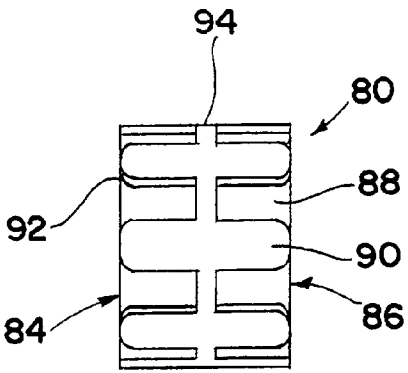
FIG. 3 is an enlarged side elevation of the bridge ring.
Figure 2:
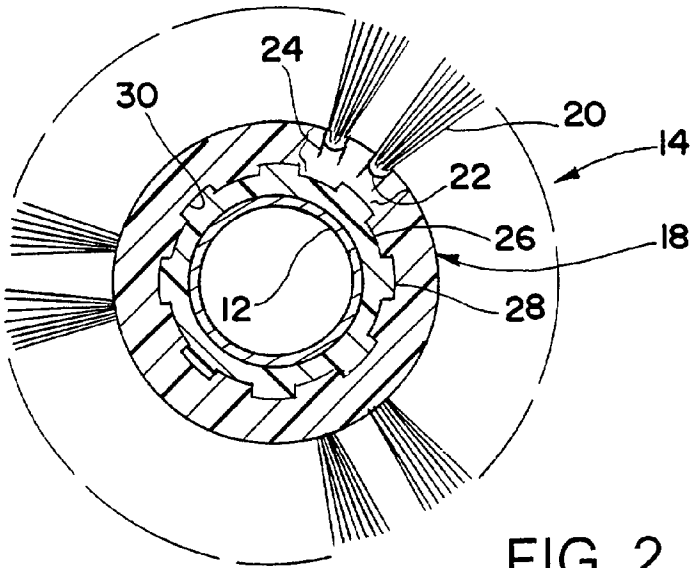
FIG. 2 is an enlarged trans-axial partial section taken substantially on the line 2—2 of FIG. 1.

Referring initially to FIG. 1 there is illustrated generally at 10 a power operated brush in accordance with the present invention. The brush is mounted for rotation on a drive arbor 12 which is illustrated in the form of a tube or pipe. Mounted on the drive arbor 12 are a plurality of brush roll segments illustrated at 14 and 16. The rolls may have a standard axial length as noted above.

Each brush roll segment comprises a plastic cylindrical hub as seen at 18 and is provided with axially spaced annular rows of bristle tufts shown at 20. The tufts 20 or projecting fabric in the case of buffs may be formed by folding a tuft of bristles into sockets 22 or grooves which are then secured in place by staples 24. The bristle material may be secured to the hub in a variety of ways, such as being formed by a plastic melt process, molded in places, or secured by adhesives such as epoxies.

The cylindrical hub 18 of each brush roll may be formed of a plastic material by extrusion and the interior of the brush roll is formed with equally circumferentially spaced alternating ridges and grooves shown at 26 and 28, respectively, to form a splined interior shown generally at 30 which extends throughout the length of the interior of each hub.

Although the brush rolls may be formed in standard lengths, it will be appreciated that if it is desired to construct a brush assembly on the power driven arbor that isn't a multiple of the standard length, the brush rolls may be cut to a shorter length if desired. The axially spaced annular rows of bristles enable the brush roll to be cut between such rolls without disturbing the bristle formation. However, other forms of bristle or fabric arrangements may be employed such as brushes with a complete bristle face or with spirally wrapped or helical rows of bristles, which may act as a conveying screw literally conveying the work along the axis of the rotating brush.

It will also be appreciated that various types of bristles may be employed to form the tufts of the rotating brush ranging from relatively soft and flexible natural or plastic bristles or a combination of both to stiffer wire bristles, or for more aggressive operations, abrasive containing plastic bristles may be employed.

Figure 5:
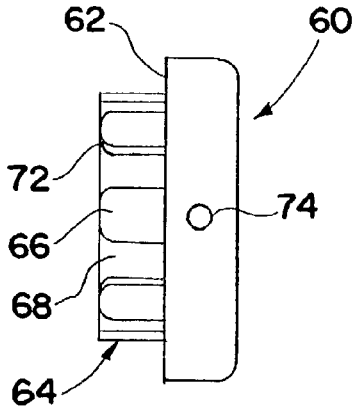
FIG. 5 is a side elevation of one end cap.
Figure 6:
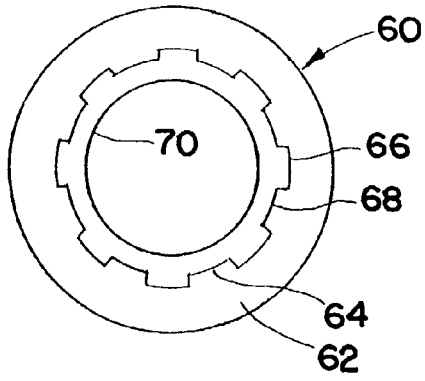
FIG. 6 is an enlarged end elevation of the end cap taken from the left hand side of FIG. 5.
Figure 7:
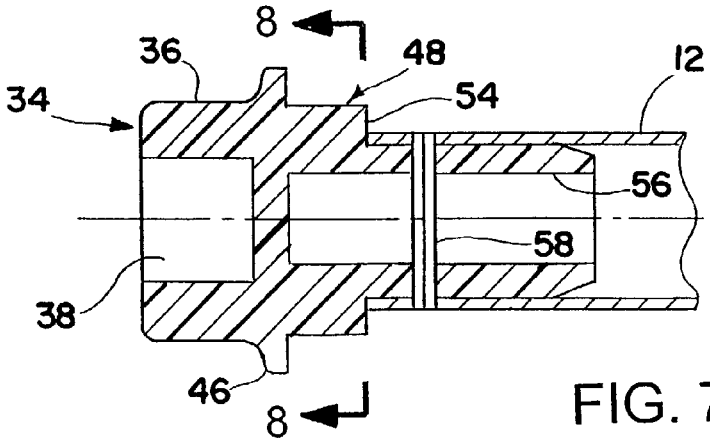
FIG. 7 is an axial enlarged section of the other projecting socket end cap which may be assembled on either end of the drive arbor.
Figure 8:
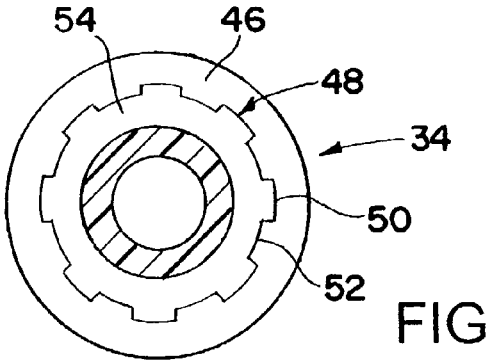
FIG. 8 is a trans-axial section taken from the line 8—8 of FIG. 7.

Referring now additionally to FIGS. 3–8, and more particularly to FIGS. 7 and 8, it will be seen that the brush roll modules in a standard length or cut length may be mounted on the drive arbor using an end cap shown generally at 34. The end cap 34 is provided with a projection 36 which may include a square, hexagonal, slotted, oval, or non-circular socket 38 to receive the end 40 of drive shaft shown generally at 42 in FIG. 1. As illustrated the drive shaft may incorporate a universal joint 44 so that the axis of the power driven brush may be positioned at an angle or inclined. As illustrated the shaft and socket are square. However if used as a journal on the opposite end, the socket is cylindrical.

As seen in FIGS. 1, 7 and 8, the end cap 34 includes a radially projecting flange 46 against which the end of the hub of the brush roll 18 seats. The end cap includes a short external spline section 48 comprising the alternating ridges and grooves 50 and 52 seen in FIG. 8. The external spline section 48 extends from the flange 46 to shoulder 54 against which the end of the drive arbor 12 seats. The end cap 34 includes an interior pilot extension 56 which extends inside the drive arbor and the end cap is drivingly connected to the drive arbor by transverse pin or key 58. In this manner there is provided a torque connection between the end cap 34 and the drive arbor 12. The pin or key may be inserted through aligned holes illustrated in the drive arbor and the pilot projection 56 of the end cap 34.

The opposite end of the power operated brush may be provided with the same end cap illustrated in FIGS. 7 and 8, or at least one having a cylindrical socket to provide an internal or external journal support, or it may be provided with the somewhat simplified end cap shown at 60 in FIG. 1 and in greater detail in FIGS. 5 and 6.

The end cap 60 includes a shoulder 62 against which the end of the brush roll 16 seats. Extending axially from the shoulder is a short external spline section 64 which includes the alternating ridges 66 and grooves 68. The interior 70 of the end cap 60 fits closely over the drive arbor. As illustrated, the ridges 66 of the short spline section preferably have tapered noses or corners illustrated at 72 to enable the external spline section more easily to seat into the end of the internal spline of the brush roll hub. Transverse opening 74 is provided through the end cap and accommodates a pin or key 76 extending through aligned holes in the end cap and the end of the drive arbor.

The pins or keys 58 and 76 provide a torque connection between the ends of the drive arbor and the two end-most brush rolls. However, in order to provide a torque connection between adjoining brush rolls there is provided a bridge ring shown at 80 and illustrated more clearly in FIGS. 3 and 4. The bridge ring 80 includes an interior 82 which fits over the drive arbor and two oppositely directed relatively short exterior spline sections shown generally at 84 and 86. Each includes alternating ridges and grooves 88 and 90, and again the projecting ridges are provided with tapered ends seen at 92. The bridge ring includes a center relatively short unsplined section or flange seen at 94 which provides a stop for the axial movement of the brush rolls during assembly. The bridge rings provide torque connections between the adjoining brush roll segments or sections with the external spline sections on the bridge rings engaging the interior spline sections in the brush roll hubs.

The end of the drive arbor as seen at the right hand side of FIG. 1 may be closed with a plug 96 sealing the interior of the drive arbor.

For the plastic components of the power operated brush which include the hubs of the brush roll segments, the end caps, either form, the bridge ring, and the plug 96, it is preferred that a plastic having some degree of lubricity and slightly deformable be employed to facilitate the assembly and disassembly of the parts. Examples of suitable plastic materials are low density polyethylenes (LDPE), polypropylene, polyester, nylon, other polyethylenes, polyvinyl chlorides, polycarbonates, and polyethylene terephthalates. Also, when properly assembled, the various components will normally seal the interior of the drive arbor against fluid intrusion. Conversely, if fluid is supplied internally, through certain ports or nozzles, the construction will ensure that the fluid goes where it is supposed to go. Fluids are widely used in many brushing operations, whether the fluid be water for cleaning, coolant for abrading operations, or even fluids including entrained abrasives.

In addition to the power operated brush, there is of course also disclosed a method of forming the power operated brush which comprises the steps, not in order, of mounting a plurality of axially aligned cylindrical brush or buff rolls on a drive arbor, placing end caps on each end of the drive arbor to provide a torque connection between the ends of the drive arbor and the ends of the outermost brush rolls, and connecting axially adjoining brush or buff rolls to provide a torque connection therebetween.

In the assembly process, the number of modules or brush rolls may be selected for the desired length of power operated brush and any partial or cut down brush roll may be employed. One of the end caps is then placed on the drive arbor and secured in place with the pin. The components are then stacked on the drive arbor with the mating spline sections driven into place for seating engagement. Proper seating may be achieved with a gentle rap by a small mallet. When the selected roll segments and interconnecting bridge rings are finally assembled, the opposite end cap may be positioned in place and provided with the torque connection to the drive arbor. The power operated brush or buff may be disassembled simply by removing the end caps and pulling the components apart. Again a gentle rap with the mallet may assist in the disassembling process.

When the components are properly seated and assembled, the plastic components substantially seal the interior of the drive arbor against water intrusion.

A particularly beneficial application for the power operated brush has been found to be in the cleaning of fruits or vegetables such as peaches, pears, apples, tomatoes or other produce.

Although the invention has been shown and described with respect to certain preferred embodiments, it is obvious that equivalent alternations and modifications will occur to others skilled in the art upon the reading and understanding of this specification. The present invention includes all such equivalent alterations and modifications, and is limited only by the scope of the claims.

What is claimed is:

1. A method of forming a power operated brush or buff comprising the steps of mounting a plurality of axially aligned cylindrical brush or buff rolls on a drive arbor, placing end caps on each end of the drive arbor to provide a torque connection between the ends of the drive arbor and the ends of the outermost rolls, using an internal bridge ring to provide the torque connection between adjoining rolls, and providing short external spline sections on the end caps and bridge ring mating with a splined interior of the rolls to provide the torque connection between the rolls and the drive arbor.

2. A method as set forth in claim 1 including the step of utilizing a transverse pin or key to provide the torque connection between the end caps and drive arbor.

3. A method as set forth in claim 1 including the step of forming the end caps, bridge ring and rolls of a rigid yet slightly deformable plastic so that when the parts are properly assembled the arbor will be substantially sealed against fluid intrusion, or for the controlled direction of fluids.

4. A method of forming a power operated brush or buff comprising the steps of mounting a plurality of axially aligned cylindrical brush or buff rolls on a drive arbor, placing end caps on each end of the drive arbor to provide a torque connection between the ends of the drive arbor and the ends of the outermost rolls, utilizing a transverse pin or key to provide the torque connection between the end caps and drive arbor, connecting axially adjoing rolls using an internal bridge ring to provide a torque connection there between, and forming the end caps, bridge ring and rolls of a rigid yet slightly deformable plastic so that when the parts are properly assembled the arbor will be substantially sealed against fluid intrusion, or for the controlled direction of fluids, providing short external spline sections on the end caps mating with a splined interior of the rolls to provide the torque connection between the ends of the outermost rolls and the drive arbor and including the step of providing short oppositely directed external spline sections on said bridge ring mating with the splined interior of the rolls to provide the torque connection between adjoining rolls.

5. A method as set forth in claim 4 including the step of providing a non-circular socket in the end of one of said end caps for transmitting torque to the power operated brush or buff.

6. A method as set forth in claim 5 including the steps of assembling one of said end caps to said drive arbor and then axially driving a roll on to said end cap to form a tight spline connection, and then driving one end of the bridge ring into the opposite end of the roll, and then driving the next roll onto the opposite end of the bridge ring to form the torque connection between the rolls.

7. A method as set forth in claim 6 including the step of driving the other of the end caps into the opposite end most roll to form the tight spline connection, and providing a torque connection between the other end cap and the drive arbor.

8. A method as set forth in claim 7 including the step of forming the rolls, end caps and bridge rings of plastic having a degree of surface lubricity to facilitate assembly and disassembly of the parts.

* * * * *